United States Patent [19]

Lichter

[11] Patent Number: 5,020,450

[45] Date of Patent: Jun. 4, 1991

[54] APPARATUS FOR MOUNTING A SAFE IN A FLOOR

[76] Inventor: Robert J. Lichter, 15571 Placid Cir., Huntington Beach, Calif. 92647

[21] Appl. No.: 527,096

[22] Filed: May 22, 1990

[51] Int. Cl.[5] ..... E05G 1/00; G12B 9/08

[52] U.S. Cl. ..... 109/50; 109/51; 248/27.1

[58] Field of Search ..... 248/27.1, 27.3, 906; 109/50, 51, 52

[56] References Cited

U.S. PATENT DOCUMENTS

| | | | |
|---|---|---|---|
| 2,031,861 | 2/1936 | Simek | 248/27.1 X |
| 2,063,923 | 12/1936 | Gries | 248/906 X |
| 2,286,898 | 6/1942 | Cover | 248/906 X |
| 2,315,746 | 4/1943 | Stewart | 248/906 X |
| 2,340,823 | 2/1944 | Scott | 248/906 X |
| 2,793,782 | 5/1957 | Austin | 248/27.1 X |
| 3,014,476 | 12/1961 | Barnett | 248/27.1 X |
| 3,683,827 | 8/1972 | Enright | 109/50 |
| 4,083,314 | 4/1978 | Garvin | 109/50 |
| 4,120,473 | 10/1978 | Suk | 248/27.1 |
| 4,370,935 | 2/1983 | Link | 109/51 |
| 4,712,490 | 12/1987 | Lichter | 109/69 |

FOREIGN PATENT DOCUMENTS

| | | | |
|---|---|---|---|
| 0090675 | 10/1983 | European Pat. Off. | 109/51 |
| 2903176 | 7/1980 | Fed. Rep. of Germany | 248/27.3 |

*Primary Examiner*—Lloyd A. Gall

*Attorney, Agent, or Firm*—Richard L. Gausewitz

[57] ABSTRACT

A floor safe has wings mounted on it in a high strength manner. The wings are adapted to be bent outwardly by bolts disposed in the valuables chamber of a safe, the bolts being operable when the safe door is not present. When the bolts are threaded outwardly so as to spread the wings, the safe may not be removed from the floor without physically destroying a substantial portion of the floor in the vicinity of the safe.

3 Claims, 2 Drawing Sheets

APPARATUS FOR MOUNTING A SAFE IN A FLOOR

BACKGROUND OF THE INVENTION

It is often necessary to mount a safe in the floor of a building, mobile home, trailer, motor home, etc. The floor in which the safe is to be mounted can have different thicknesses, and may be made of different materials such as (for example) plywood, boards, plastic or sheet metal.

The optimum safe-mounting apparatus and method will have characteristics such that:

(a) The mounting will be very strong, as strong as the strengths of the floor materials permit, so that the safe will not be removable without destruction of the surrounding portion of the floor itself.

(b) The mounting will be achieved in a matter of a few minutes, once the safe has been located and an opening of appropriate size and shape has been formed in the floor.

(c) The same safe will be mountable equally well with floor boards, plywood, metal or plastic, having a variety of thicknesses, with no need for the person doing the mounting to know or care how thick the floor is.

(d) The mounting apparatus and method will be such that the outer end of the safe will be held very solidly against the upper surface of the floor, in a strong and snug manner.

(e) The mounting apparatus will be very economical to manufacture, and will be so simple to operate that unskilled persons will have no difficulty performing the mounting operation.

(f) The safe will be removable, by its owner, with little or no damage to the floor around the safe opening.

SUMMARY OF THE INVENTION

In accordance with the present invention, a floor safe is associated with wing elements that are forced outwardly after the safe has been inserted into an opening in the floor. The forcing is effected by elements disposed in part within the valuables chamber, so that a thief has no access thereto.

The wing elements are so constructed and so related to the safe, and to the floor walls that define the opening in the floor, that a wedging action is created in response to the outward forcing of the wings. The wings engage lower corners or edges of the floor walls that define the floor opening, regardless of the thickness of the floor, within the conventional range of floor thicknesses. Thus, automatically, and regardless of floor thickness, the safe is retained very tightly in position in the floor. This reduces the risk that the safe may be withdrawn from the floor opening.

In the preferred form, the wing elements are caused to bend sharply at lower edges of the opening walls, regardless of the thickness of the floor.

In accordance with the method, wing elements are mounted on the exterior of a floor safe. The floor safe and wing elements are inserted through an opening in the floor, the opening corresponding substantially to the size of the safe. The safe is prevented from dropping through the opening, as by flanges at the upper end of the safe. Then, elements within the valuables chamber of the safe are operated to force the wings outwardly and lock them in their outer positions. The upper portions of the wings bend around lower corners of walls defining the floor opening. The safe is thus caused to be held very tightly against the floor and against attempts to remove it from the floor opening.

The wings are so related to the safe and to the floor that a very strong resistance is presented to removal of the safe by a burglar.

DETAILED DESCRIPTION OF THE PREFERRED EMBODIMENT

Figure 1:
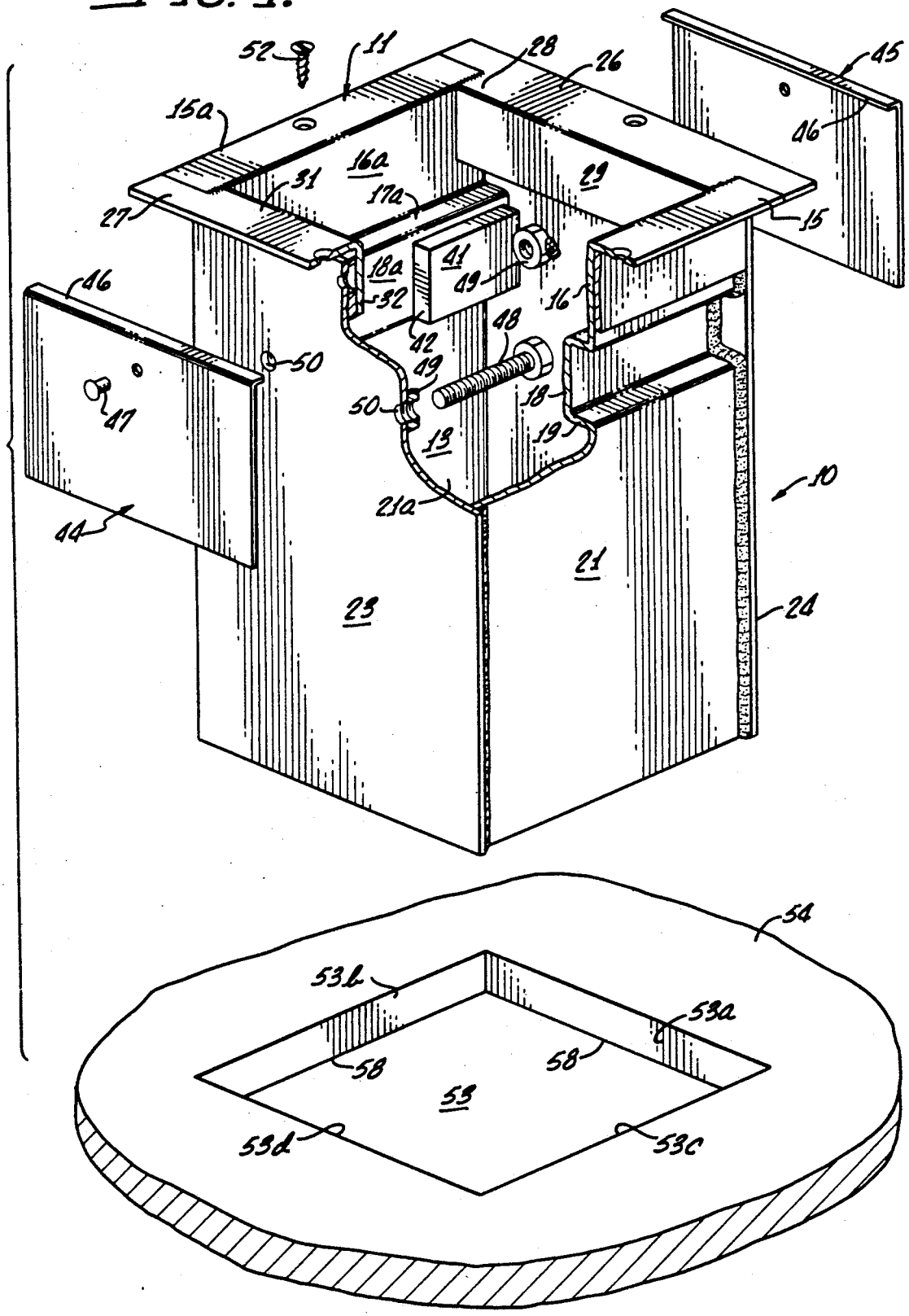
FIG. 1 is a partially exploded isometric view of a combination safe, floor, and safe-mounting means in accordance with the present invention.

Referring to the drawings, the illustrated safe comprises a hollow body 10 having an outwardly-extending flange 11 at the upper end thereof. Body 10, and a strong door 12, define a valuables chamber 13 adapted to contain papers, jewelry, stock and bond certificates, etc.

Stated more definitely, the illustrated safe comprises a long sheet of heavy-gauge sheet metal. Starting at the upper-right portion of FIG. 1, such long piece of sheet metal forms a horizontal flange portion 15, a vertical upper wall portion 16, and inwardly-extending horizontal ledge portion 17, a vertical portion 18, and an outwardly-extending horizontal portion 19. The long sheet then bends vertically downwardly to form a large panel 21 the lower end of which is bent a right angle to form the bottom wall 22 (FIG. 2) of the safe.

The remaining portions of the long sheet of sheet metal are the mirror images of the portions 15–19 and 21 described above. Most of these portions are given the same numbers as those just stated, except followed in each instance by the letter "a".

There are welded to opposite edge portions of the above-described long piece of sheet metal two walls 23,24 that are identical to each other. Walls 23,24 cooperate with panels 21 and **21*a*, and strong door 12, to define the valuables chamber 13. The walls 23,24 extend all the way from bottom wall 22 upwardly to regions near but not touching the flange 11. Such flange 11 is formed not only by flange portions 15 and 15*a*, but by flange portions 26 and 27 shown in FIGS. 1 and 2**.

Unlike flange portions **15,15*a*, flange portions 26,27 extend both inwardly and outwardly from the walls 23,24 beneath them. Thus, flange portion 26 has an inner indented portion 28 that is bent downwardly to form a vertical locking wall 29 for door 12. Similarly, flange portion 27 has an inner indented portion 31 that is bent downwardly to form a vertical locking wall 32. The lower edges 33,34 of vertical walls 29,32 lie generally in the same horizontal plane and are spaced above ledges 17,17*a* by distances somewhat greater than the thickness of door 12. These edges 33,34 are locking edges and cooperate with the undersides of reinforcing bars 36,37 that are welded in position between the lower regions of walls 29,32 and the inner faces of walls 23,24 as shown in section in FIG. 2**.

The elements 26,29 and 31,32 are welded to elements 15,16 and **15*a*,16*a*, in such manner that the flange portions 15,15*a*,26 and 27 lie in the same plane. Furthermore, the relationships are such that vertical wall 29 is spaced much further from its associated wall 24 than the vertical wall 32 is spaced from its associated wall 23**. This is part of the sliding-door invention that is described in U.S. Pat. No. 4,712,490, issued Dec. 15, 1987, for a Safe. Said patent is hereby incorporated by reference herein.

Mounted on the upper side of door 12 are a handle 38 and a dial 39, the latter forming part of a combination safe mechanism that operates a slide bolt (not shown in the present drawings but shown at 56 in the above-cited patent). A steel block 41 is welded solidly on vertical wall portion 18*a* (FIG. 1), and has a vertical stop face 42 adapted to be engaged by one vertical edge of the above-indicated bolt described in the cited patent, after the dial 39 has been so operated as to cause the bolt to extend toward vertical wall portion 18*a*.

To close the access opening of the safe, the operator so operates the dial 39 as to retract the bolt of the locking mechanism. Then, he or she holds the handle 38 in such manner that the lower-right edge of door 12 extends downwardly at an angle into the access opening at the upper portion of the safe. The right edge of the door 12 is then slid along ledges 17,17*a* until wall 24 is engaged by the door edge, such door edge then being beneath edge 33 and reinforcing bar 36.

The door is then pivoted downwardly to a horizontal position, following which it is slid back, to the left, until the left edge of the door engages the inner surface of wall 23. Then, dial 39 is so operated as to cause the bolt to extend to a position at which one vertical edge of the bolt (the edge closest to wall 24) is closely adjacent stop face 42. Thus, the bolt and stop face prevent the door 12 from being slid toward wall 24. It follows that the door 12 is maintained beneath both locking edges 33,34 and both reinforcing bars 36,37. A very high-strength locking relationship is thus created as described in the cited patent.

There will next be described the means, additional to flange 11, to mount the safe in an opening in a floor and maintain the safe in secure relationship therein. This comprises two rectangular wing elements or wings 44,45. The wings 44,45 are preferably formed of sheet metal, preferably steel, that can be bent sharply as by a brake. Stated otherwise, the sheet metal is preferably such that when pressed it will bend and form a sharp corner, the elastic limit of the metal being exceeded at such corner. The corner may be termed a "pivot" or "pivot region".

In its original form, as shown in FIG. 1, each wing 44,45 is planar except that a narrow flange 46 is bent at the upper end of each sheet. Each wing of sheet 44,45 has a horizontal dimension that is preferably only slightly smaller than the horizontal dimension of each wall 23,24. The vertical dimension of each wing or sheet 44,45 is preferably at least several inches.

Each wing 44,45 is mounted on the safe in such manner as to present great resistance to downward movement of the wing relative to the safe. In the preferred form, the upper edge portion of each wall 23,24 (FIG. 2) does not extend upwardly to the flange portion 26,27 thereabove, but instead terminates at a distance below such flange that is sufficient to provide a gap that will receive the flange 46. At the factory, each wing is mounted on the safe by inserting flange 46 in the indicated gap, and then using a rivet 47 to hold the wing on the safe during shipment and storage of the safe and during insertion of the safe into the floor. The wings 44,45 are shown in phantom line in FIG. 2 in their as-mounted conditions.

The means for securing the safe in a floor opening further comprise elongate bolts 48 that are threaded through nuts 49, the latter being welded on the interior surfaces of walls 23,24 in registry with holes 50 in such walls. Two such bolts 48 are shown as being provided relative to each wing 44,45, one bolt being adapted to engage the interior wing surface relatively adjacent one side of the safe, and the other bolt being adapted to engage the interior wing surface relatively adjacent the other side of the safe. The bolts, nuts and holes are spaced downwardly a substantial distance from flange portions 26,31, but this distance is not so great that the bolt ends will not remain in engagement with the interior wing surfaces after the bolts have been threaded outwardly until their heads engage the nuts 49. An additional set of bolts, nuts and holes is provided on the opposite wall, these being mirror images of the bolts, etc., 48–49. The nuts and holes are so oriented that the bolts 48 extend perpendicularly to their respective walls 23,24.

DESCRIPTION OF THE METHOD

A first step in the method comprises providing a safe body having one or more wings mounted thereon, the wings being initially adjacent the exterior safe surface and being preferably opposite each other. Preferably, the wings are secured to the safe at the factory, as above described.

The next step comprises cutting an opening 53 in a section of floor 54 (bottom portion of FIG. 1), such opening corresponding generally to the size and shape of the safe body cross-section. The opening 53 has walls 53*a*,53*b*,53*c* and 53*d* that are preferably vertical. Walls 53*b* and 53*c* are spaced from each other a distance sufficient that the safe body 10 will fit between them, with the walls 21 and 21*a* respectively adjacent the floor walls 53*c* and 53*b*.

Figure 2:
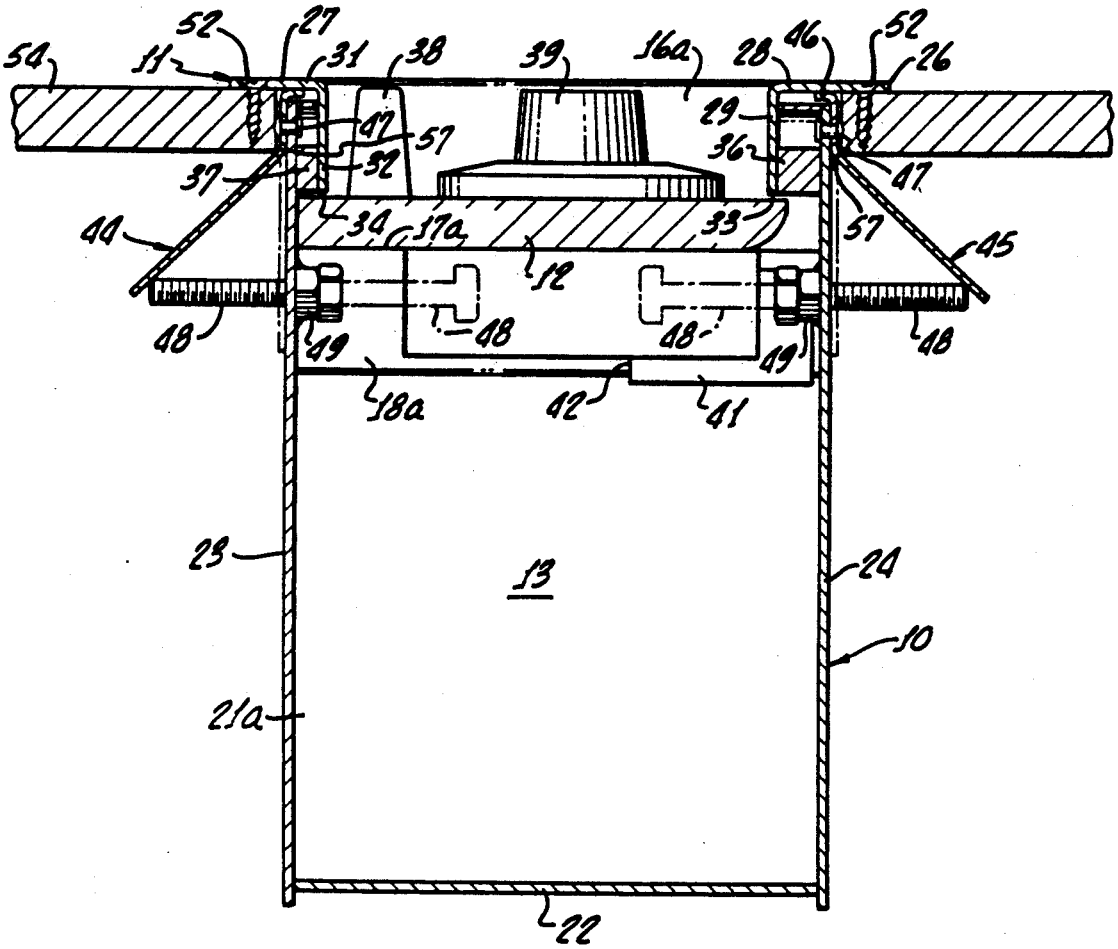
FIG. 2 is a vertical sectional view showing the safe as fully mounted in tightly-inserted relationship in the floor opening.

The floor walls 53*a* and 53*d* are spaced from each other a distance barely sufficient to receive between them the safe body, the wings 44,45 and the head of the rivets 47. Referring to FIG. 2, it is emphasized that the upper portions of the wing bodies are sandwiched rather closely between walls 23,24 and walls 53*d*,53*a*. Thus, it is not only the rivets 47 that hold the wings in position. Rather, it is the sandwiching of the wings between the opening walls and the safe walls, in combination with the sandwiching of the flanges 46 between flange 11 and the upper edges of walls 23,24, that effectively hold the wings in position despite any attempt by a burglar to lift the safe out of the floor opening 53.

As the next step in the method, while the bolts 48 are in their inward positions shown in phantom line in FIG. 2, and while the wings 44,45 are in their as-mounted positions shown in phantom line in FIG. 2, the safe body 10 and the wings 44,45 are introduced into the opening as far as permitted by the flange 11. Then, preferably but not necessarily, screws 52 are inserted through the flange 11 at spaced points therearound, being threaded into the floor 54. Then, the bolts 48 are turned in such directions are to thread them outwardly, so that the outer ends of the bolts engage the inner surfaces of wings 44,45 and apply outward pressure thereto. Preferably, the bolts relative to each wing are operated alternately so as to cause a relatively uniform outward shifting and bending of each wing except at the upper end portion thereof.

As the two (or other number of) bolts for each wing 44 press outwardly against the wings, the wings bend sharply about bend or pivot regions 57 that are not the same of each installation. Instead, the location of the bend or pivot region 57 depends upon the thickness of the floor 54. In each instance, the bend is at the lower corner 58 (FIG. 1) of the floor at opening 53.

The corners 58 operate as bend-support regions, and to some extent as fulcrums, that determine where the wings 44,45 bend. In addition, the bending tends to draw the safe further into the opening 53 in floor 54, making the flange 11 snugly engaged with the upper floor surface.

The outward threading of the bolts is continued until the bolt heads engage the nuts 49. The wings 44,45 are then in their outwardly-bent conditions, for example at approximately 45° angles relative to the safe walls 23,24.

When a burglar attempts to lift the safe out of the floor, such lifting is initially prevented by the corners 58 in cooperation with the wings 44. It is emphasized that the upper regions of the wings cannot move downwardly relative to safe walls 23,24 because the wing flanges 46 bear down on the upper edges of walls 23,24. Thus, removal of the safe is effectively prevented unless the burglar destroys the floor 54 in the region of the safe. In the event a joist is so close to the safe as to prevent full outward extension of the bolts on either side or both sides of the safe, the bolts may be removed and then cut off by an appropriate amount, and then reinserted.

Referring to FIG. 2, it is pointed out that—on each side of the safe, the bolts 48, wings 44 or 45, and upper regions of walls 23 or 24 form very strong triangles or trusses. These present great resistance to pulling of the safe. Thus, even if corners 57 are crushed, or even if floor regions outwardly from the corners are crushed, the triangles will resist pulling of the safe. Only if the floor is destroyed outwardly of these triangles can the safe be pulled.

In the event it is desired to move the safe to another vehicle or building, or to a different location in the same vehicle or building, this can be accomplished by the owner of the safe because all mounting and demounting operations are performed with the door 12 removed. Thus, to move the safe, the various bolts 48 are threaded inwardly so as to no longer protrude through holes 50. Then, the screws are removed from flange 11, following which suitable tools are employed to lift upwardly on flange 11 and pull the safe. This results in a camming action by which the wings 44 are bent back into their positions parallel to and closely adjacent the walls 23,24, such action being possible because the bolts 48 are not then bearing on the wings.

The present apparatus and method make it possible to effectively mount a safe in a floor economically and quickly, normally in a very small fraction of the time required by prior art apparatus and methods.

The word "floor" as used in this specification and claims also includes "wall". The word "floor" (which includes "walls") denotes the type of floor referred to at the beginning of this specification and also shown in the drawings. It does not denote a concrete floor slab that is poured on the ground.

The foregoing detailed description is to be clearly understood as given by way of illustration and example only, the spirit and scope of this invention being limited solely by the appended claims.

What is claimed is:

1. A combination floor section, floor safe, and mounting means for securing said floor safe in an opening in said floor section, comprising:

(a) a floor section having an opening therein, (b) a floor safe having a body that defines a valuables chamber, having an access opening to said valuable chamber, and having a strong door that blocks said access opening and prevents ingress to said valuables chamber except by a person capable of opening said door, said safe having a flange extending outwardly therefrom in the vicinity of said access opening, said flange being sufficiently large to engage the upper surface of said floor section around said opening in said floor section to thereby prevent said safe from moving downwardly farther than permitted by said flange, said body of said safe having gap means therein relatively adjacent the underside of said flange, (c) wing means provided exteriorly of said safe and extending downwardly from upper edge portions of said wing means to lower distal portions that are located substantial distances beneath the underside of said floor section, said wing means having flanges at the upper ends thereof and which extend into said gap means, said flanges of said wing means cooperating with the body of said safe at an underside of said gap means to prevent said wing means from moving downwardly relative to said safe, and (d) elongate threaded fastener means threaded through walls of said safe and having outer ends disposed to engage said wing means at locations spaced substantial distances from said flanges of said wing means, said threaded fastener means being threaded outwardly to maintain said wing means in spread relationship relative to said safe whereby the lower corners of said floor section at said opening therein are engaged by said wing means to thus prevent pulling of said safe through said floor opening.

2. The combination as claimed in claim 1, in which said wing means comprise at least one relatively strong sheet of sheet metal, said sheet of sheet metal being bendable, whereby said sheet bends at the lower corner of said floor section at said opening therein, regardless of the thickness of said floor section, said bend in said sheet cooperating with said outwardly-extending flange to firmly anchor said floor safe against movement in either an upward or downward direction, said sheet metal being adapted when bent to take a permanent set so that the bend at said lower corner is abrupt and not substantially radiused.

3. The combination as claimed in claim 2, in which said wing means comprises two wings respectively provided on opposite sides of said safe.

* * * * *